US006165019A

United States Patent [19]

Kha et al.

[11] Patent Number: 6,165,019

[45] Date of Patent: Dec. 26, 2000

[54] COAXIAL CABLE FILTER ASSEMBLY

[75] Inventors: Thong B. Kha, Simi Valley, Calif.; Gary Knaus, Horseheads, N.Y.

[73] Assignee: Thomas & Betts International, Inc., Sparks, Nev.

[21] Appl. No.: 09/449,517

[22] Filed: Nov. 24, 1999

[51] Int. Cl.[7] ..... H01R 13/66

[52] U.S. Cl. ..... 439/620; 333/182

[58] Field of Search ..... 439/620, 188, 439/578–585; 333/181, 182, 183, 184, 185

[56] References Cited

U.S. PATENT DOCUMENTS

| | | | |
|---|---|---|---|
| 2,779,924 | 1/1957 | Du Chatellier | 333/76 |
| 3,593,217 | 7/1971 | Weber | 333/70 |
| 3,603,902 | 9/1971 | Denes | 333/79 |
| 3,617,830 | 11/1971 | Perna, Jr. | 317/242 |
| 3,747,028 | 7/1973 | Pennypacker | 333/10 |
| 4,743,873 | 5/1988 | Schultz et al. | 333/175 |
| 4,755,776 | 7/1988 | Preschutti | 333/100 |
| 4,845,447 | 7/1989 | Holdsworth | 333/167 |
| 4,901,043 | 2/1990 | Palinkas | 333/175 |
| 5,145,412 | 9/1992 | Tan et al. | 439/620 |
| 5,150,087 | 9/1992 | Yoshie et al. | 333/185 |
| 5,213,522 | 5/1993 | Kojima | 439/620 |
| 5,278,525 | 1/1994 | Palinkas | 333/175 |
| 5,413,504 | 5/1995 | Kloecker et al. | 439/620 |
| 5,415,569 | 5/1995 | Colleran et al. | 439/620 |
| 5,632,637 | 5/1997 | Diener | 439/188 |
| 5,883,553 | 3/1999 | Tsumura | 333/174 |
| 6,025,760 | 2/2000 | Tang | 333/100 |

*Primary Examiner*—Gary F. Paumen
*Assistant Examiner*—Ross Gushi
*Attorney, Agent, or Firm*—G. Andrew Barger

[57] ABSTRACT

An in-line and ninety degree filter assembly is provided in the present invention for coupling a coaxial cable thereto. The coaxial cable has a coaxial wire disposed therein. The filter assembly includes a filter body that has a first end and a second end spaced apart from the first end. A circuit board is secured within the filter body for filtering electrical signals received from the coaxial cable. The circuit board includes a center coax in electrical and mechanical communication with the circuit board and a ground lead connected to the circuit board and protruding therefrom for electrically and mechanically communicating with the filter body upon installation of the circuit board into the filter body such that the circuit board is electrically grounded to the filter body.

20 Claims, 4 Drawing Sheets

COAXIAL CABLE FILTER ASSEMBLY

FIELD OF THE INVENTION

In general, the present invention relates to filters and, in particular, the present invention relates to a coaxial cable filter assembly for filtering an electrical signal received from and transmitted to a coaxial cable.

BACKGROUND

Typical filter assemblies for coaxial cables have a number of installation disadvantages due to their large diameters and long length, making the assemblies difficult to install in small electrical boxes and confined spaces where coaxial cable is run. Compounding these disadvantages is the way in which these assemblies are constructed. First, a PC board is populated with components including a center coax and other subassembly components. Next the assembly is soldered together. The subassembly is then welded to an inner shield. Compression foam is then mixed and applied about the inner shield. The subassembly, inner shield, and surrounding foam are then inserted into the outer shield of the assembly. Unconnected parts of the assembly are then welded together.

In addition, the circuit board requires soldering to ground such as to the filter assembly body. What's more, because of size and manufacturing constraints, a ninety degree filter assembly has yet to be constructed, which greatly reduces the adaptability and installation capabilities of the filter assemblies in restricted spaces such as pedestals, apartment boxes, drop control boxes, and wall plates.

SUMMARY OF THE INVENTION

The present invention eliminates the above difficulties and disadvantages by providing an in-line and ninety degree filter assembly for coupling a coaxial cable thereto. The coaxial cable has a coaxial wire disposed therein. The filter assembly includes a filter body having a first end, and a second end spaced apart from the first end. In the ninety degree filter assembly the second end has an insertion aperture, and a welding aperture spaced apart from the insertion aperture. A circuit board is secured within the filter body for filtering electrical signals received from the coaxial cable. The circuit board includes a center coax in electrical and mechanical communication with the circuit board, and a ground lead connected to the circuit board and protruding therefrom for electrically and mechanically communicating with the filter body upon installation of the circuit board into the filter body such that the circuit board is electrically grounded to the filter body.

In the ninety degree filter assembly, a conductor is mechanically and electrically coupled to the center coax in the second end. A spacer is also provided as well as a dielectric cylinder that encompasses the conductor and is disposed, at least partially, within the spacer by compression fit. A fastener is also provided within which the spacer is coupled. The fastener abuts the insertion aperture of the second end of the filter assembly. Further included in the present invention is a cover that is coupled to the second end and that covers the welding aperture. A coupler is connected thereto for receiving the coaxial wire of the coaxial cable. A coax guide member at least partially encompasses the coupler for guiding the coaxial wire of the coaxial cable into electrical and mechanical connection with the coupler and for preventing environmental elements from entering the first end of the filter body.

DETAILED DESCRIPTION OF THE PREFERRED EMBODIMENT(S)

Figure 1:
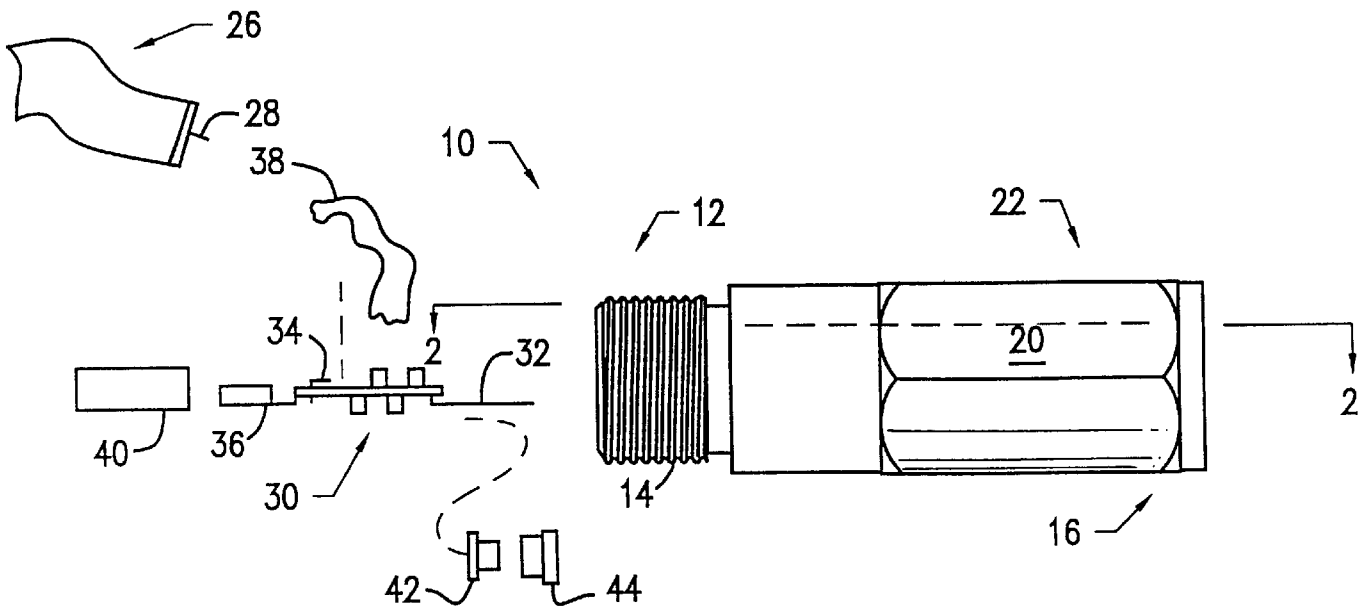
FIG. 1 is an exploded view of an in-line filter assembly of the present invention.

The above and other features, aspects, and advantages of the present invention will now be discussed in the following detailed description and appended claims, which are to be considered in conjunction with the accompanying drawings in which identical reference characters designate like elements throughout the views. Shown in FIG. 1 is a filter assembly, which is preferably an in-line filter assembly 10, for coupling a coaxial cable 26 thereto. The coaxial cable 26 has a coaxial wire 28 disposed therein and is of the type commonly used in the cable TV industry for supply a plurality of cable channels to a set-top box. The typical frequency band for cable channels ranges from fifty-five megahertz, normally representing cable channel two, to one-thousand megahertz (one gigahertz), normally representing cable channel one hundred. The present invention blocks undesirable low frequency bands in the five to forty megahertz range in both the return and receiving paths and preferably passes high frequency bands in the fifty-four megahertz to one gigahertz range. Moreover, the filter assembly features a frequency reject depth of minus forty-five decibels.

Figure 2:
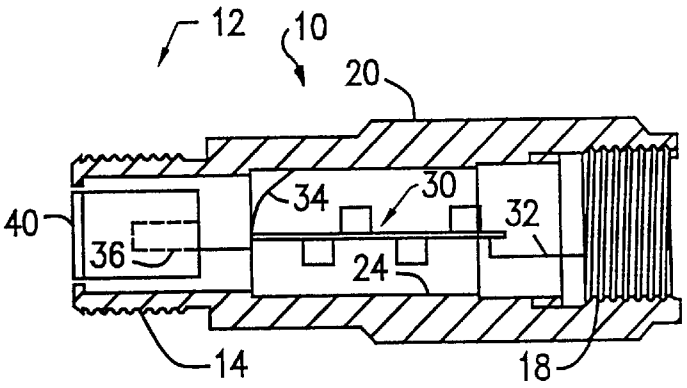
FIG. 2 is a cross sectional view taken along sight line 2—2 of FIG. 1 of the in-line filter assembly of the present invention.
Figure 3:
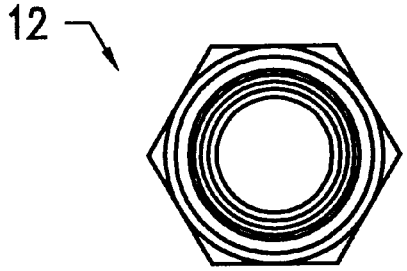
FIG. 3 is a side elevational view of a first end of the in-line filter assembly of the present invention.
Figure 4:
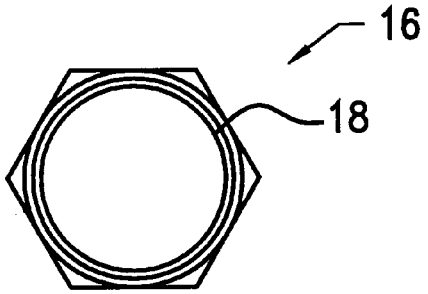
FIG. 4 is a side elevational view of a second end of the in-line filter assembly of the present invention.

The in-line filter assembly 10 includes a filter body 22 that has a first end 12 and a second end 16 spaced apart from the first end 12. Further shown in FIG. 3 is the first end 12 of the filter body 22, which has external threads 14 disposed thereon for coupling the in-line filter assembly 10 to a connector secured to an end of the coaxial cable. Moreover, shown in FIGS. 2 and 4 is the second end 16 of the filter body 22, which has internal threads 18 for coupling the in-line filter assembly 10 to a cable box. The filter body 22 further includes a hex shaped surface 20, as is best shown in FIG. 1, for gripping by an installation tool.

Figure 5:
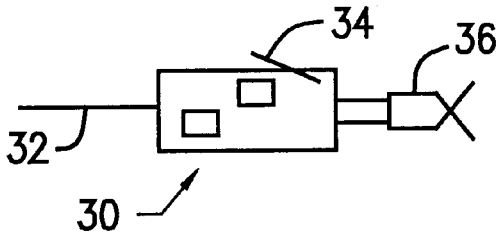
FIG. 5 is a plan view of a circuit board of the present invention.

As is best shown in FIGS. 1 and 5, a circuit board 30 is secured within the filter body 22 for filtering electrical signals received from the coaxial cable and sent from the cable box such as when a user orders a pay-per-view movie on the cable box. The circuit board 30 is populated with various circuit components for preferably performing the high pass filtering function as described above, but other frequency ranges could also be filtered, and includes a center coax 32 that is in electrical and mechanical communication with the circuit board 30. A ground lead 34 is also connected to the circuit board 30 and protrudes therefrom for electrically and mechanically communicating with the filter body 22 upon installation of the circuit board 30 into the filter body 22 such that the circuit board 30 is electrically grounded to the filter body 22. In particular, the ground lead 34 protrudes from the circuit board 30 on an angle such that it abuts the interior 24 of the filter body 22, which is shown in FIG. 2. The circuit board 30 further includes a metallic coupler 36, as shown in FIGS. 1 and 5, which is connected thereto for receiving the coaxial wire 28 of the coaxial cable 26 therein.

Preferably, a moisture preventative conformal coating is applied to the circuit board 30 such as acrylic or polyurethane to prevent moisture from coming in conact with the components of the circuit board 30. The conformal coating is applied by brushing or spraying the coating on the circuit board 30. An insulative tape 38 such as MYLAR, can also be applied about the circuit board 30 to prevent the components mounted on the circuit board 30 from shorting to ground, which in this instance is the filter body 22. The tape 38 of the present invention is shown in FIG. 1. In the past, tape was applied about circuit boards only to keep components on the circuit boards from moving. Such tape, however, failed to act as an insulator and prevent circuit board components from shorting to ground.

Figure 15:
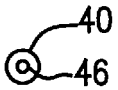
FIG. 15 is a side elevational view of a coax guide member of the present invention.

As shown in FIG. 1 a coax guide member 40 at least partially encompasses the coupler 36 for guiding the coaxial wire 28 of the coaxial cable 26 into electrical and mechanical connection with the coupler 36 and for preventing environmental elements from entering the first end 12 of the filter body 22. The coax guide member 40 is preferably made of thermo-formed plastic. As shown in FIG. 15, an aperture 46 is disposed in the coax guide member 40 in which the coaxial wire 28 of the cable is introduced, thereby ensuring proper connection with the coupler 36.

As shown in FIG. 1, disposed in the second end 16 of the filter body 22 is a dielectric spacer 68 that is coupled about the center coax 32 of the circuit board 30 and annularly abuts the interior 24 of the filter body 22. The spacer 68 is also preferably constructed of a thermo-plastic. Further shown in FIG. 1 is a metallic end piece 44 that is coupled about the dielectric spacer 42 for preventing environmental elements from entering the second end 16 of the filter body 22. The dielectric spacer 42 is coupled to a metallic end piece 44 via compression fit.

Figure 8:
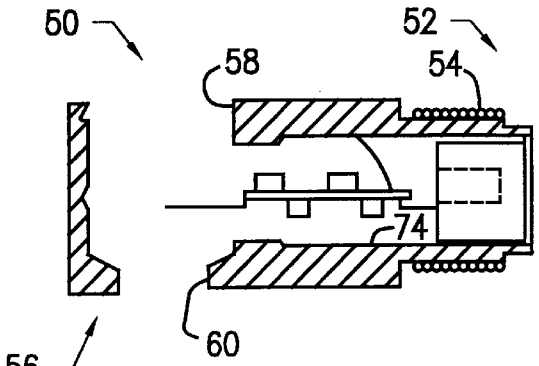
FIG. 8 is a cross sectional view taken along sight line 7—7 of FIG. 8 of the ninety degree filter assembly of the present invention.
Figure 10:
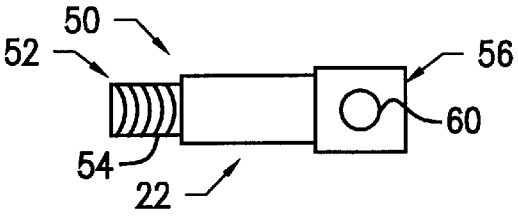
FIG. 10 is another plan view of the ninety degree filter assembly of the present invention.
Figure 9:
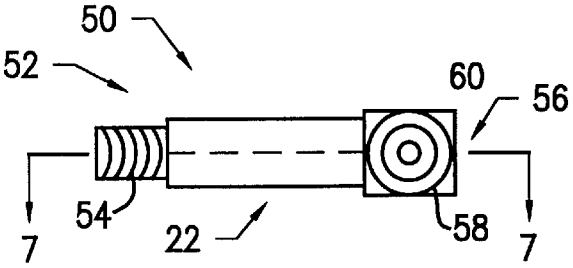
FIG. 9 is a plan view of the ninety degree filter assembly of the present invention.

Referring with specificity to FIGS. 6–15, a ninety degree filter assembly 50 is shown for coupling a coaxial cable 26 thereto and for filtering low frequency signals sent from the coaxial cable 26 and received from a cable box. The filter assembly 50 includes a filter body 22 having a first end 52, and a second end 56 spaced apart from the first end 52. As shown in FIGS. 6, 7,9, 10, and 12, the first end 52 has external threads 54 for coupling to a connector on the end of the coaxial cable 26. As shown in FIGS. 9 and 10, respectively, the second end 56 has an insertion aperture 58, and a welding aperture 60 spaced apart from the insertion aperture 58, which will be discussed in greater detail below.

Figure 7:
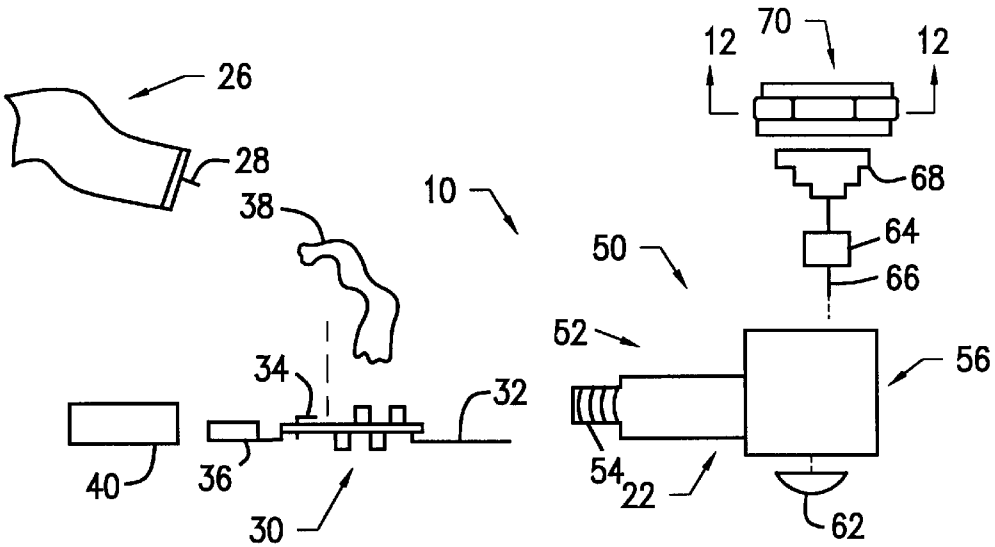
FIG. 7 is an exploded view of the ninety degree filter assembly of the present invention.

As is best shown in FIG. 7, a circuit board 30 is secured within the ninety degree filter assembly 50 for filtering electrical signals received from the coaxial cable 26 and sent from the cable box such as when a user orders a pay-per-view movie on the cable box. The circuit board 30 is populated with various circuit components for preferably performing a high pass filtering function, but other frequency ranges could also be filtered, and includes a center coax 32 that is in electrical and mechanical communication with the circuit board 30. A ground lead 34 is also connected to the circuit board 30 and protrudes therefrom for electrically and mechanically communicating with the ninety degree filter assembly 50 upon installation of the circuit board 30 into the filter body 22 such that the circuit board 30 is electrically grounded to the filter body 22. In particular, the ground lead 34 protrudes from the circuit board 30 on an angle such that it abuts the interior 74 of the first end 52 of the ninety degree filter assembly 50, which is shown in FIG. 8. The circuit board 30 further includes a metallic coupler 36, as shown in FIG. 7, which is connected thereto for receiving the coaxial wire 28 of the coaxial cable 26.

Preferably, a moisture preventative conformal coating is applied to the circuit board 30 such as acrylic or polyurethane. The conformal coating is applied by brushing or spraying the coating on the circuit board 30. An insulative tape 38 such as MYLAR, can also be applied about the circuit board 30 to prevent grounding of circuit board components to the filter body 22 as discussed above. The tape 38 of the present invention is shown in FIG. 7.

As shown in FIGS. 7 and 15, a coax guide member 40 at least partially encompasses the coupler 36 for guiding the coaxial wire 28 of the coaxial cable 26 into electrical and mechanical connection with the coupler 36 and for preventing environmental elements from entering the first end 52 of the ninety degree filter assembly 50. The coax guide member 40 is preferably made of thermo-formed plastic. As shown in FIG. 15, an aperture 46 is disposed in the coax guide member 40 in which the coaxial wire 28 of the cable is introduced, thereby ensuring proper connection with the coupler 36.

Figure 14:
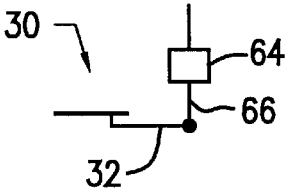
FIG. 14 is a side elevational view of a conductor being soldered to a center coax of the present invention.

During assembly of the ninety degree filter assembly 50, a conductor 66 is mechanically and electrically coupled to the center coax 32 in the second end 56, as shown in FIG. 14. Specifically, once both the conductor 66 and center coax 32 are abutting within the second end 56 of the ninety degree filter assembly 50, a welding tool is inserted through the welding aperture 60 and the conductor 66 and center coax 32 are welded together. Disposed about the conductor 66 is a dielectric cylinder 64, which is also preferably constructed of thermo-formed plastic and contained within the second end 56 of the ninety degree filter assembly 50.

Figure 6:
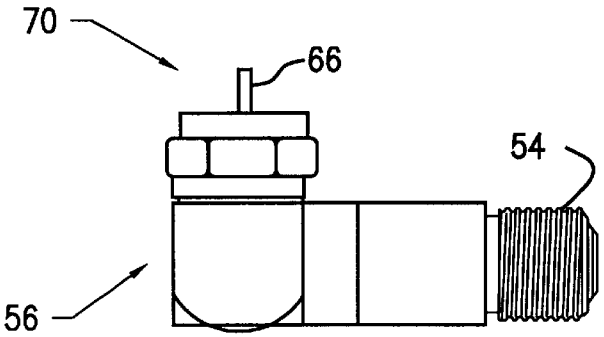
FIG. 6 is a side elevational view of a ninety degree filter assembly of the present invention.
Figure 11:
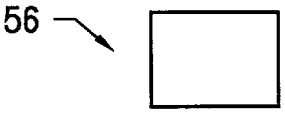
FIG. 11 is a side elevational view of a second end of the ninety degree filter assembly of the present invention.
Figure 13:
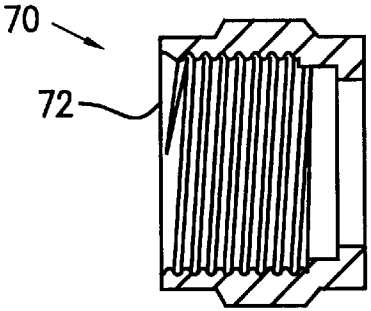
FIG. 13 is a cross sectional view taken along sight line 12—12 of FIG. 7 of a fastener of the present invention.
Figure 12:
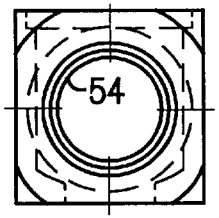
FIG. 12 is a side elevational view of a first end of the ninety degree filter assembly of the present invention.

A metallic spacer 68 is also provided in the present invention and the dielectric cylinder 64 is disposed, at least partially, within the spacer 68 by compression fit. Referring in particularity to FIGS. 6, 7, and 13, a fastener 70 is also provided within which the spacer 68 is coupled via compression fit. The fastener 70 includes inner threads 72 as shown in FIG. 13 for coupling the fastener 70, and hence the first end 52 of the ninety degree filter assembly 50, to a threaded terminal on a cable box, for example. The fastener

70 abuts the insertion aperture 58 of the second end 56 of the ninety degree filter assembly 50 and is secured to the second end 56 by the spacer 68. The cylinder 64 is secured in the spacer 68 and secured about the conductor 66, which in turn is soldered to the center coax 32. Further included in the present invention is a cover 62, as shown in FIG. 7, which is coupled to the second end 16 and that covers the welding aperture 60. The cover 62 is also press fit over the welding aperture 60 of the second end 56.

Although the invention has been described in detail above, it is expressly understood that it will be apparent to persons skilled in the relevant art that the invention may be modified without departing from the spirit of the invention. Various changes of form, design, or arrangement may be made to the invention without departing from the spirit and scope of the invention. Therefore, the above mentioned description is to be considered exemplary, rather than limiting, and the true scope of the invention is that defined in the following claims.

What is claimed is:

1. A filter assembly for coupling a coaxial cable thereto, the coaxial cable having a coaxial wire disposed therein, the filter assembly comprising:

a filter body having:

a first end, and a second end spaced apart from the first end; and a circuit board secured within the filter body for filtering electrical signals received from the coaxial cable, the circuit board including:

a center coax in electrical and mechanical communication with the circuit board, and a ground lead connected to the circuit board and protruding therefrom for electrically and mechanically communicating with the filter body upon installation of the circuit board into the filter body such that the circuit board is electrically grounded to the filter body.

2. The filter assembly of claim 1 further comprising a moisture preventative coating applied on the circuit board.

3. The filter assembly of claim 1 further comprising an insulative tape applied about the circuit board.

4. The filter assembly of claim 1 wherein the filter assembly is an in-line filter assembly.

5. The filter assembly of claim 1 wherein the circuit board further comprises a coupler connected thereto for receiving the coaxial wire of the coaxial cable.

6. The filter assembly of claim 5 further comprising a coax guide member at least partially encompassing the coupler for guiding the coaxial wire of the coaxial cable into electrical and mechanical connection with the coupler and for preventing environmental elements from entering the first end of the filter body.

7. The filter assembly of claim 1 further comprising a dielectric spacer coupled about the center coax of the circuit board and annularly abutting the filter body.

8. The filter assembly of claim 7 further comprising an end piece coupled about the dielectric spacer for preventing environmental elements from entering the second end of the filter body.

9. A filter assembly for coupling a coaxial cable thereto, the coaxial cable having a coaxial wire disposed therein, the filter assembly comprising:

a first end, and a second end spaced apart from the first end, the second end including:

an insertion aperture, and a welding aperture spaced apart from the insertion aperture;

a circuit board secured within the filter assembly for filtering electrical signals received from the coaxial cable, the circuit board including:

a center coax in electrical and mechanical communication with the circuit board, and a ground lead connected to the circuit board and protruding therefrom for electrically and mechanically communicating with the filter assembly upon installation of the circuit board into the filter assembly such that the circuit board is electrically grounded to the filter assembly;

a conductor mechanically and electrically coupled to the center coax in the second end; and a fastener abutting the insertion aperture of the second end of the filter assembly and through which the conductor extends at least partially and is coupled thereto.

10. The filter assembly of claim 9 further comprising a cover coupled to the second end and covering the welding aperture.

11. The filter assembly of claim 9 further comprising a moisture preventative coating applied on the circuit board.

12. The filter assembly of claim 9 further comprising a spacer.

13. The filter assembly of claim 12 further comprising a dielectric cylinder encompassing the conductor and disposed, at least partially, within the spacer by compression fit.

14. The filter assembly of claim 9 wherein the circuit board further comprises a coupler connected thereto for receiving the coaxial wire of the coaxial cable.

15. The filter assembly of claim 14 further comprising a coax guide member at least partially encompassing the coupler for guiding the coaxial wire of the coaxial cable into electrical and mechanical connection with the coupler and for preventing environmental elements from entering the first end of the filter assembly.

16. The filter assembly of claim 9 further comprising a dielectric spacer coupled about the center coax of the circuit board and annularly abutting the filter assembly.

17. The filter assembly of claim 16 further comprising an end piece coupled about the dielectric spacer for preventing environmental elements from entering the second end of the filter assembly.

18. A filter assembly for coupling a coaxial cable thereto, the coaxial cable having a coaxial wire disposed therein, the filter assembly comprising:

a filter body having:

a first end, and a second end spaced apart from the first end, the second end including:

an insertion aperture, and a welding aperture spaced apart from the insertion aperture;

a circuit board secured within the filter body for filtering electrical signals received from the coaxial cable, the circuit board including:

a center coax in electrical and mechanical communication with the circuit board, and a ground lead connected to the circuit board and protruding therefrom for electrically and mechanically communicating with the filter body upon installation of the circuit board into the filter body such that the circuit board is electrically grounded to the filter body;

a conductor mechanically and electrically coupled to the center coax in the second end;

a spacer;

a dielectric cylinder encompassing the conductor and disposed, at least partially, within the spacer by compression fit;

a fastener within which the spacer is coupled, the fastener abutting the insertion aperture of the second end of the filter assembly; and a cover coupled to the second end and covering the welding aperture.

19. The filter assembly of claim 18 wherein the circuit board further comprises a coupler connected thereto for receiving the coaxial wire of the coaxial cable.

20. The filter assembly of claim 19 further comprising a coax guide member at least partially encompassing the coupler for guiding the coaxial wire of the coaxial cable into electrical and mechanical connection with the coupler and for preventing environmental elements from entering the first end of the filter body.

* * * * *